United States Patent [19]

Vieau et al.

[11] Patent Number: 4,622,781

[45] Date of Patent: Nov. 18, 1986

[54] RAIL GRINDING MACHINE

[75] Inventors: Robert G. Vieau, Plymouth; Truman A. Anderson, Minneapolis; Kevin C. Johansen, Mound, all of Minn.

[73] Assignee: Loram Maintenance of Way, Inc., Hamel, Minn.

[21] Appl. No.: 702,483

[22] Filed: Feb. 19, 1985

[51] Int. Cl.[4] ..... B24B 23/00; B24B 27/08

[52] U.S. Cl. ..... 51/178; 51/241 LG

[58] Field of Search ..... 51/178, 241 LG

[56] References Cited

U.S. PATENT DOCUMENTS

| | | | |
|---|---|---|---|
| 2,779,141 | 1/1957 | Speno et al. | 51/178 |
| 3,358,406 | 12/1967 | Speno et al. | 51/178 |
| 3,945,152 | 3/1976 | Helgemeir | 51/178 |
| 4,074,468 | 2/1978 | Panetti | 51/178 |

FOREIGN PATENT DOCUMENTS

| | | | |
|---|---|---|---|
| 0032214 | 7/1981 | European Pat. Off. | 51/178 |

*Primary Examiner*—Frederick R. Schmidt
*Assistant Examiner*—Bradley I. Vaught
*Attorney, Agent, or Firm*—Dorsey & Whitney

[57] ABSTRACT

The angle through which the grinding modules of a railroad track rail grinding machine can be tilted is increased by pivotally mounting the grinding modules on a carriage which is in turn pivotally mounted relative to the rail grinding machine's supporting, main framework. The carriage hereof provides for lateral shifting of the grinding module grinding stones relative to the track rail, as well as tilting of the grinding modules through a ninety degree arc about the rail to be ground. The flexibility of the carriage greatly enhances the rail shaping capability of each grinding module.

8 Claims, 25 Drawing Figures

30
38
32
68
44
42
152
66
64
40
3
34
62
48
60
36
52
50
46
56

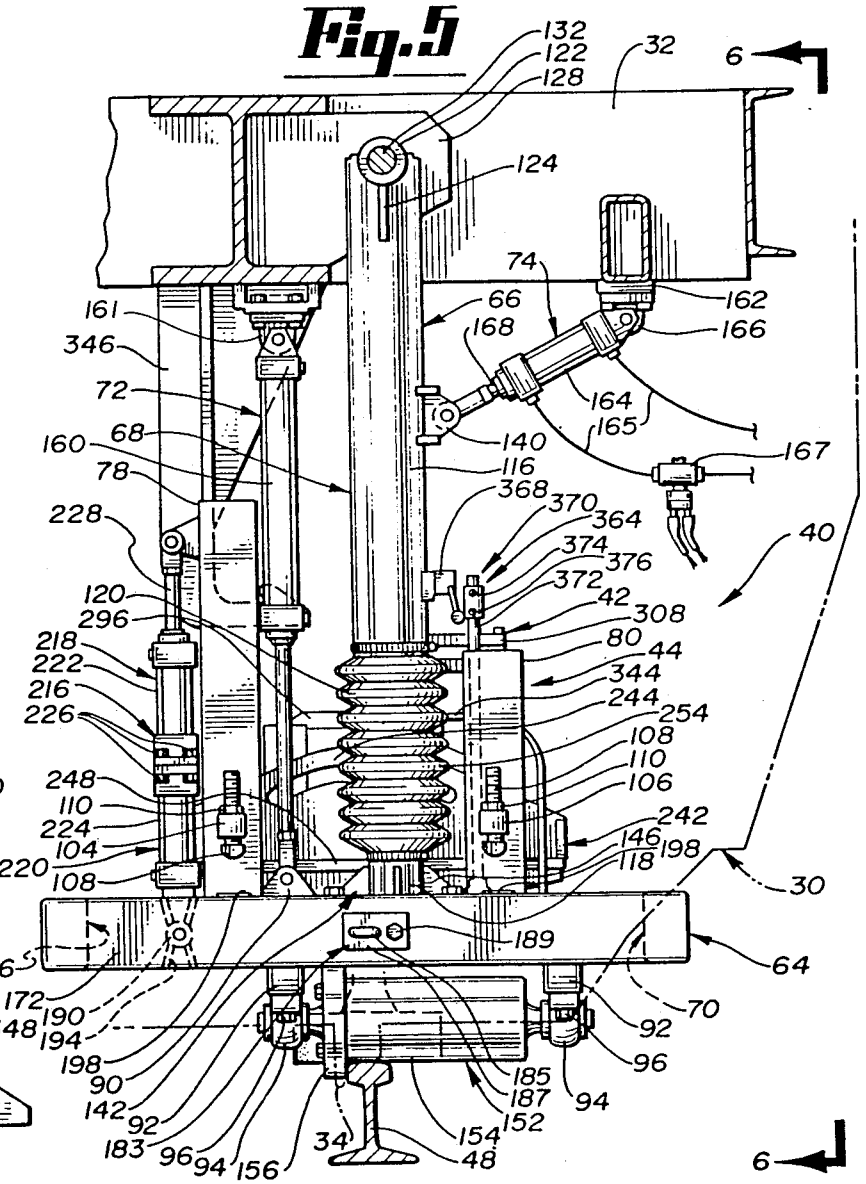
Fig. 5
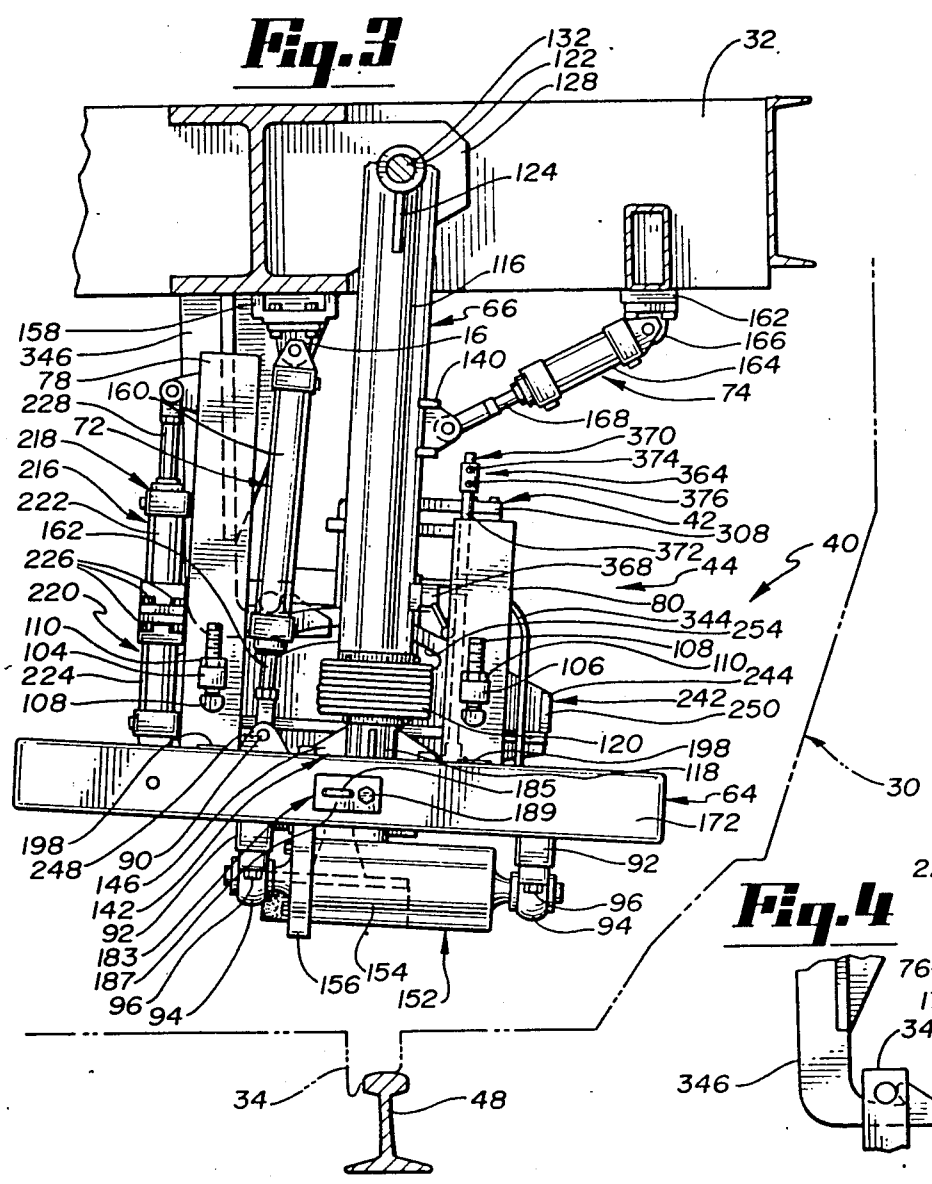
Fig. 3
Fig. 4

RAIL GRINDING MACHINE

TECHNICAL FIELD

This invention relates to rail grinding machines adapted to travel along railroad tracks and perform grinding operations on the track rail surfaces. In particular, it pertains to a unique mounting device for supporting grinding modules on such rail grinding machines.

BACKGROUND ART

Railroad track rails are subject to wear by the passage of trains over the rails. In particular, depressions in the upper surface of a rail may develop such that the rail head presents an undulating, corrugated surface. Moreover, the rail may develop burrs, or otherwise lose its symmetrical profile. Maintenance of smooth running surfaces on railroad track rails is important for reasons of safety, riding comfort, protection of the track, track bed and rolling stock, noise suppression, and reduced maintenance of the track and track bed.

Grinding machines for maintaining railroad track rails in smooth, properly shaped condition are known. Such grinding machines generally comprise a plurality of rotatable grinding modules carried, by a locomotive or the like, in close proximity to the rail head surfaces of a railroad track. The grinding modules include rotatable, abrasive grinding stones that can be lowered into a position flush with the rail surface to grind and restore the rail surface to a smooth, planar configuration.

Shaping of a rail can be accomplished by tilting the grinding module, and in particular the grinding stone, relative to the level upper surface of the railroad track rail. Examples of rail grinding machines having tiltable grinding modules include U.S. Pat. No. 4,178,724 to Bruno, U.S. Pat. No. 3,707,808 to Danko et al., U.S. Pat. No. 3,606,705 to Rivorire, U.S. Pat. No. 2,197,729 to Miller, and U.S. Pat. No. 2,132,470 to Hobson et al. The angle through which such grinding modules can be tilted, however, is restricted by the inherent size of the grinding modules, and the space limitations imposed on all railroad rolling stock due to the relatively narrow width between track rails. Such limitations have, heretofore, restricted the tilt angle of grinding modules as measured from a center reference axis. As will be appreciated, the shaping capabililty of an individual grinding module is limited by the maximum tilt angle of the grinding module.

SUMMARY OF THE INVENTION

The rail grinding machine in accordance with the present invention includes tiltable carriages for the machine's grinding modules that greatly increase the angle through which each grinding module can be tilted. In particular, the rail grinding machine hereof includes a plurality of grinding modules tiltably mounted on grinding assembly carriages, with the carriages in turn being tiltably mounted on the supporting, main framework of the grinding machinc. The resulting "double tilt" feature greatly increases the rail shaping capability of the individual grinding modules.

The rail grinding machine hereof broadly includes a supporting framework mounted on rail engaging wheels, a plurality of grinding assembly carriages tiltably carried by the framework, and a plurality of grinding modules tiltably mounted on the carriages. A coordinated system of hydraulic piston and cylinder assemblies and stop mechanisms are provided to control the angle of tilt of each grinding module.

BRIEF DESCRIPTION OF THE DRAWINGS

FIG. 1 is a front elevational view of a rail grinding machine;

FIGS. 2*a* and 2*b* together comprise a left side elevational view of a rail grinding machine, FIG. 2 being an organizational diagram showing the manner in which FIGS. 2*a* and 2*b* are to be joined;

FIG. 3 is a front elevational section taken along line 3—3 of FIG. 2*a,* showing the grinder carriage in the stowed transport position;

FIG. 4 is a front elevational detail of one transport hook hanger as it is used in FIG. 3;

FIG. 5 is a view similar to that of FIG. 3, but showing the grinder carriage in the working position;

DETAILED DESCRIPTION OF THE DRAWINGS

Figures 1, 2, 2A, 2B:
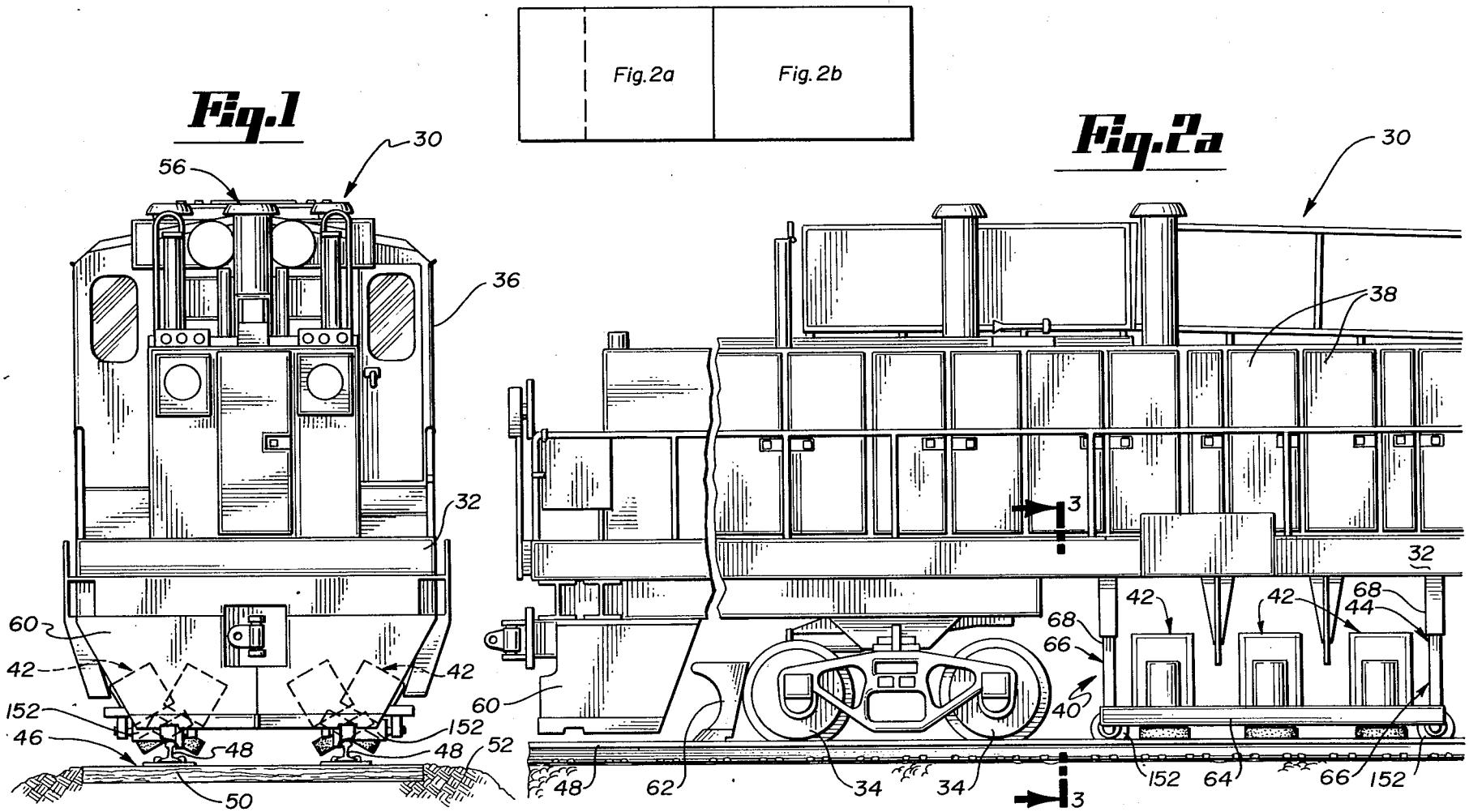
Figure 2B:
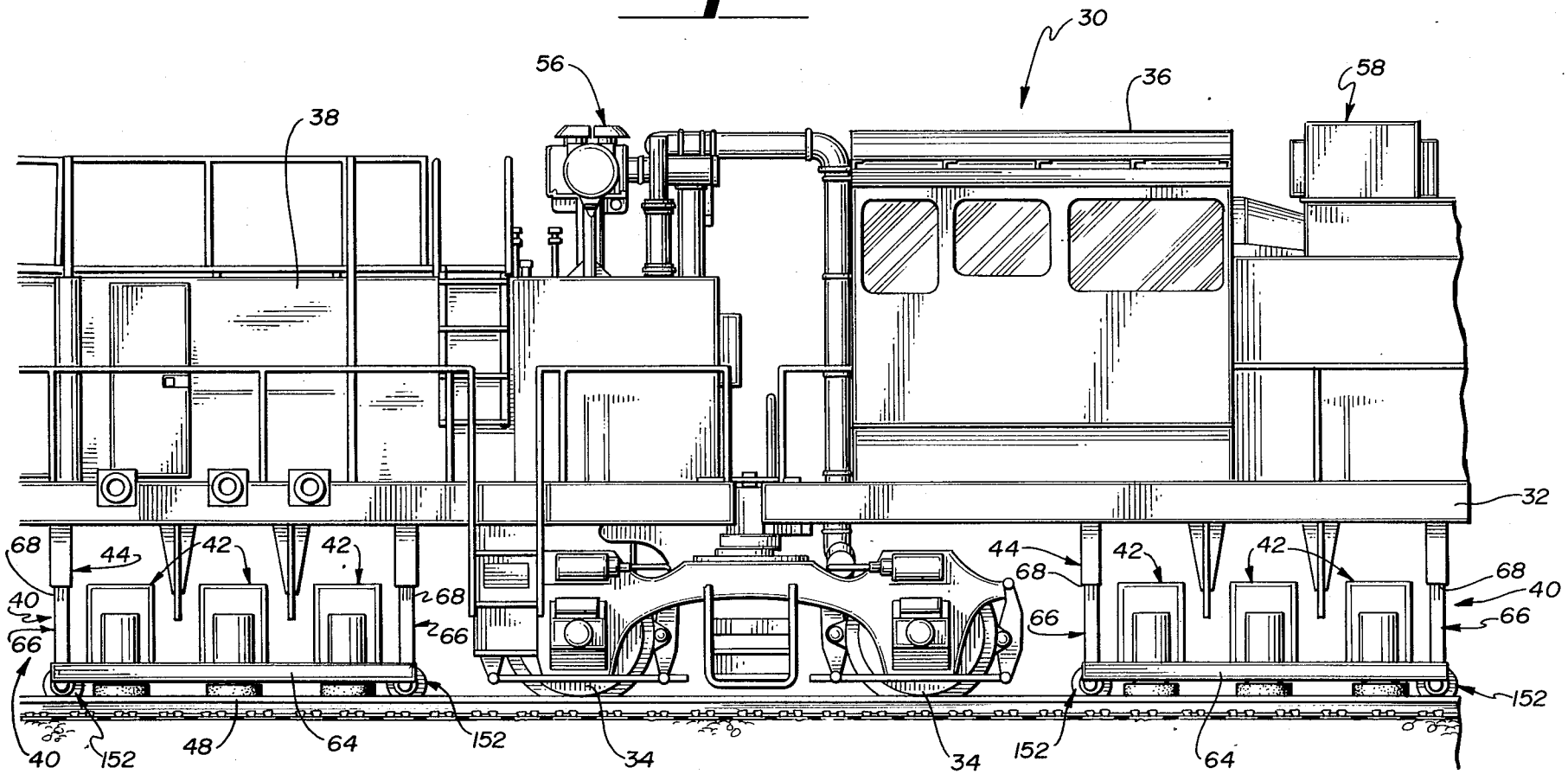

Referring to the drawings, a rail grinding machine 30 broadly includes a mainframe 32 supported by a plurality of rail-engaging wheels 34, an operator cab 36, equipment compartments 38, and a plurality of grinding assemblies 40. Each grinding assembly 40 includes a bank of three grinding modules 42 supported by a grinder carriage 44.

Referring to FIGS. 1, *2a* and *2b*, rail-engaging wheels 34 support the grinding machine 30 on railroad track 46. The track 46 comprises a pair of rails 48 stretching across ties 50 of railroad bed 52. The rail grinding machine 30 may typically include air filtering installation 56, air conditioner installations 58, snow plow assembly 60 and individual rail snow flanges 62.

Each grinder carriage 44 supports a bank of three grinding modules 42. The carriages 44 each broadly include a tilt frame 64 and fore and aft, extensible, tilt frame support structures 66 coupling the carriage tilt frame 64 to the rail grinding machine main frame 32.

As best depicted in FIGS. 3, 5, 6, and 7, the support structures 66 each include slide tube assembly 68, support brace 70, hydraulic lift piston and cylinder assembly 72, and hydraulic spread piston cylinder and assembly 74.

Figure 13:
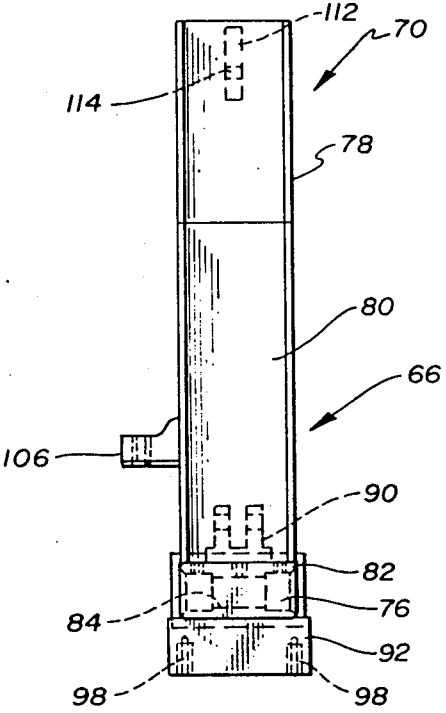
FIG. 13 is a left side elevational view of the carriage support frame, taken from the perspective of FIG. 6.
Figure 12:
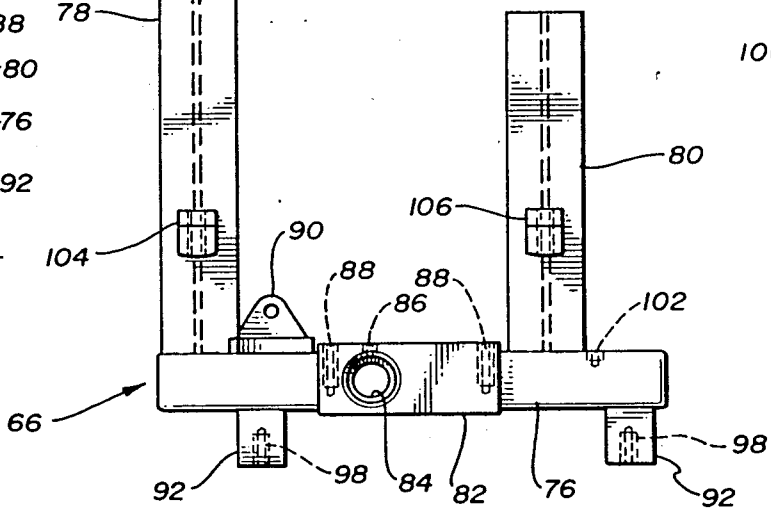
FIG. 12 is a front elevational view of the carriage support frame, taken from the perspective of FIG. 5.
Figure 11:
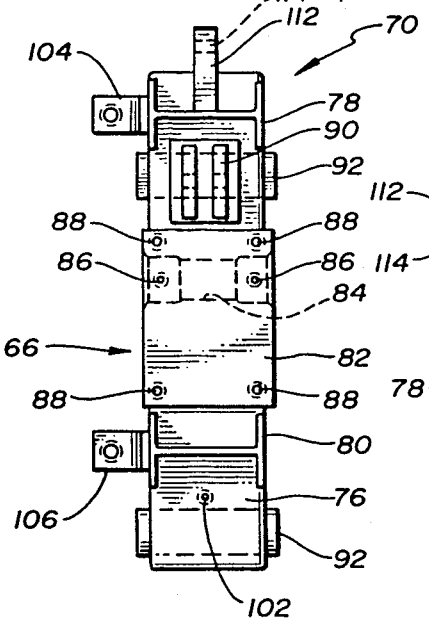
FIG. 11 is a plan view of the carriage support frame, taken from the perspective of FIG. 7.

Referring to FIGS. 11, 12 and 13, the carriage support brace 70 includes brace beam 76, and inboard and outboard upstanding I beams 78, 80. Brace beam 76 includes generally centered, tilt frame pivot box 82. Pivot box 82 includes pivot channel 84, lubricant receiving channel 86 in communication with the pivot channel 84, and threaded, bolt-receiving channels 88.

Hydraulic lift cylinder receiving clevis 90 extends upwardly from brace beam 76. Carriage wheel supporting blocks 92 depend downwardly from base beam 76. Referring to FIGS. 3 and 5, pillow block bearings 94 are fixedly attached to each block 92 by bolts 96 received through the pillow block bearings 94, and within threaded channels 98 of block 92. Brace beam 76 also includes air hose receptacle 102.

Tilt stop receiving sleeves 104, 106 are carried by the inboard and outboard upstanding I beams 78, 80 respectively. As best demonstrated in FIGS. 16 and 20, the tilt stop sleeves 104, 106 each threadably receive a stop bolt 108 with lock nut 110, for limiting the angle of tilt of the tiltable carriage frame 64. Inboard upstanding I beam 78 extends upwardly further than outward upstanding I beam 80, and includes hydraulic tilt cylinder attachment 112.

Figure 7:
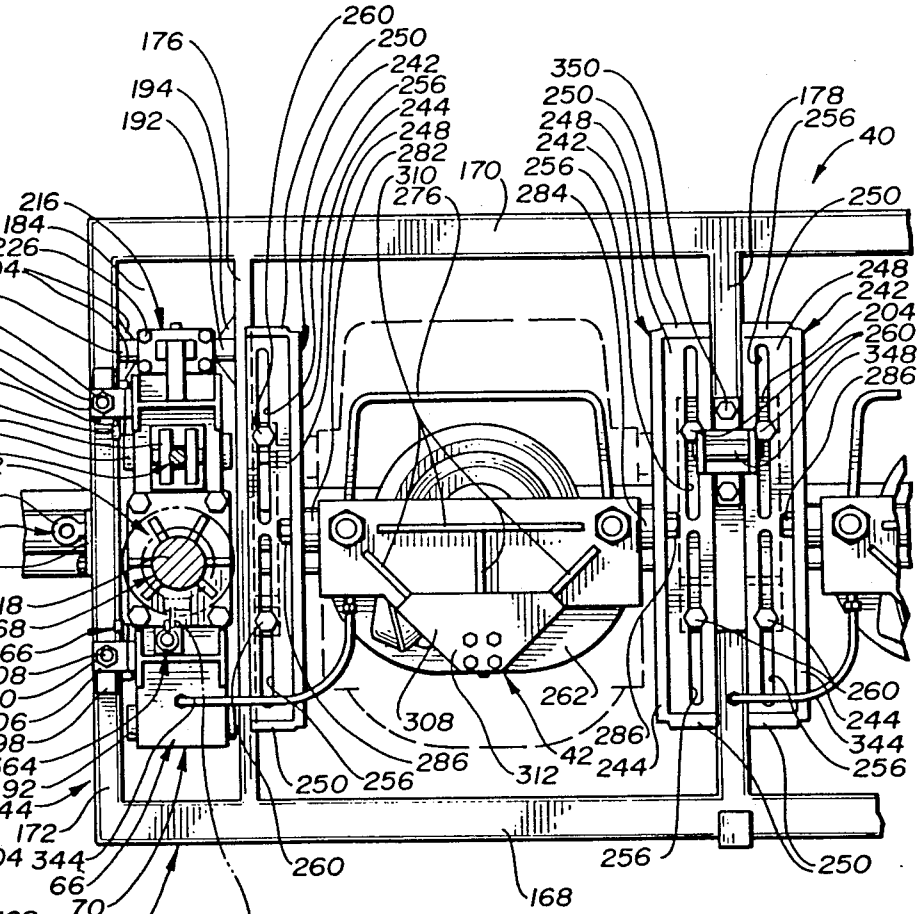
FIG. 7 is a fragmentary, plan view of the grinder carriage.
Figure 6:
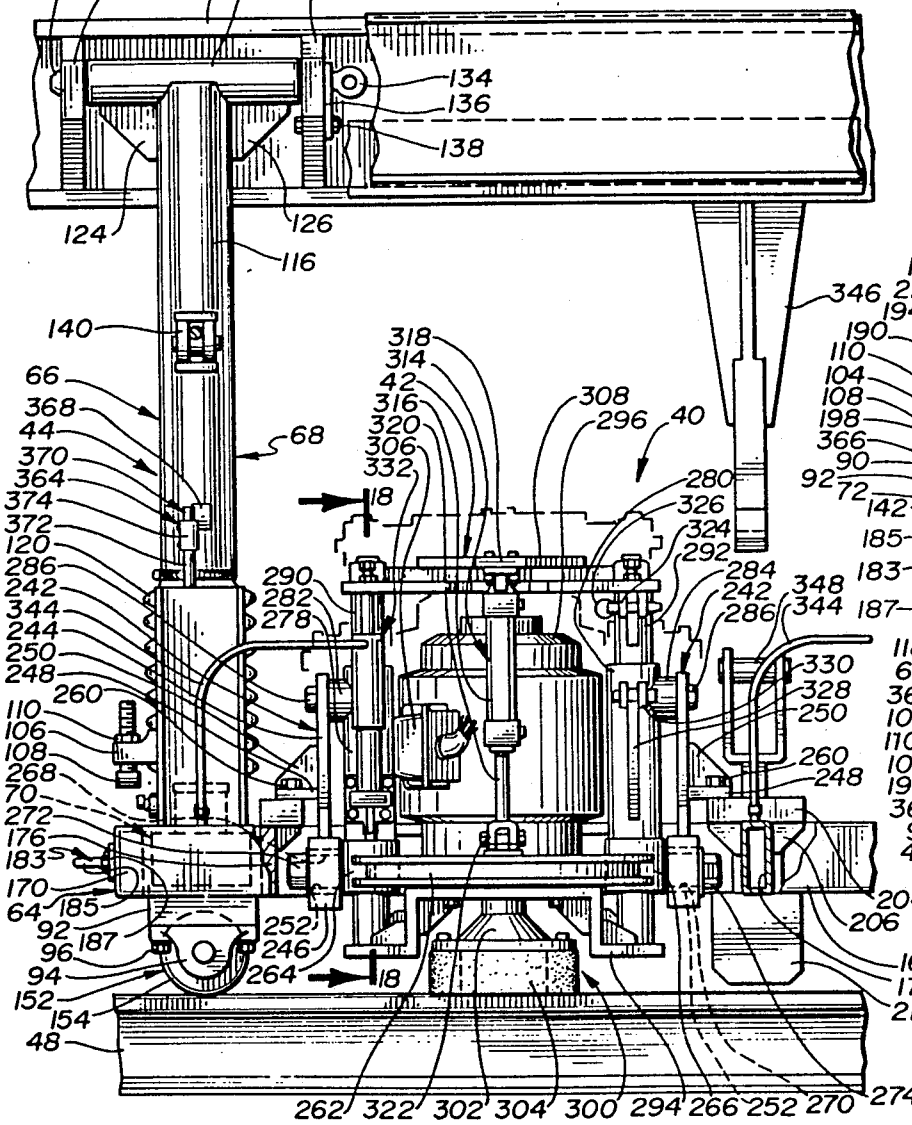
FIG. 6 is a fragmentary left side elevational detail of the forward end of the grinder carriage taken along line 6—6 of FIG. 5.

The support braces 70 are extensibly coupled to the grinding machine main frame 32 by slide tube assemblies 68. Referring to FIGS. 5–7, slide tube assembly 68 includes outer slide tube 116, and inner slide tube 118. Extensible boot 120 covers the inner slide tube 118.

Outer slide tube 116 terminates at its upper end at coupling tube 122. Support flanges 124, 126 interconnect the coupling tube 122 with the outer slide tube 116. As best depicted in FIG. 6, coupling tube 122 is pivotally retained between ears 128, 130 of main frame 32 by pivot pin 132. Pivot pin 132 includes eye 134 and integral retaining plate 136. The retaining plate 136 is fixedly attached to ear 128 by nut and bolt assembly 138. Spread cylinder attachment 140 is fixedly attached to the external surface of outer slide tube 116.

The lower end of inner slide tube 118 terminates in spider brace 142. The brace 142 includes attachment plate 144, and radially extending support flanges 146 connecting the inner slide tube 118 to plate 144.

Cylindrical carriage wheels 152 are rotatably carried by respective pairs of pillow block bearings 94. Each wheel 152 includes rail top surface engaging portion 154 and inner side rail engaging guide flange 156.

Hydraulic carriage lift piston and cylinder 72 extends between bracket 158, fixedly attached to grinding machine main frame 32, and clevis 90, fixedly attached to the carriage support structure brace beam 76. The cylinder 160 of assembly 72 is pivotally coupled to bracket 158 by attachment 161. The rod 162 of assembly 72 is pivotally coupled to clevis 90.

Hydraulic spread piston and cylinder assembly 74 extends between slide tube attachment 140 and bracket 162, fixedly connected to main frame 32. The cylinder 164 of assembly 74 is pivotally connected to the bracket 162 via attachment 166. The rod 168 of assembly 74 is pivotally connected to the spread cylinder attachment 140. Hydraulic fluid carrying lines 165 connected to cylinder 164 include actuating switch 167.

Referring to FIGS. 8, 9, 10 and 23, the carriage tilt frame 64 includes opposed side beams 168, 170, front and rear beams 172, 174, and grinding module support beams 176, 178, 180, 182. The tilt frame 64 is pivotally coupled to the tilt frame support structure by pivot pin 183. Pin 183 includes eye 185 and plate 187, and is retained in place by bolt 189 received through plate 187. Front beam 172 and support 176 define carriage support structure base beam receiving space 184. Carriage tilt frame pivot pin receiving channels 186, 188 extend through front beam 172 and support beam 176 respectively. Tilt actuating cylinder pivot pin receiving tubes 190, 192 extend inwardly from front beam and support beam 172, 176 respectively. The tubes 190, 192 are supported by brace flanges 194.

Stop engaging pads 198 project upwardly from the front beam 172. Grinding module support plate 200 is fixedly attached to the upper surface of support beam 176 via braces 202. Support plate 204 is fixedly attached to support beam 178 via braces 206. Support plate 200 includes threaded, bolt-receiving channels 208. Plate 204 includes threaded bolt-receiving channels 210. Rail guard plate 212 extends downwardly from support beam 178, supported by brace 214.

Hydraulic tilting actuator 216 extends between attachment 112 of inboard upstanding I beam 78, and pivot pin tubes 190, 192. Tilt actuator 216 comprises upper and lower back-to-back double acting hydraulic piston and cylinder assemblies 218, 220. Cylinders 222, 224 of assemblies 218, 220 respectively, are fixedly connected together by bolts 226. Piston rod 228 of upper piston and cylinder assembly 218 is pivotally coupled to attachment 112. Piston rod 232 of lower piston and cylinder assembly 220 is pivotally coupled to pivot pin tubes 190, 192.

Figures 18, 19, 20, 21:
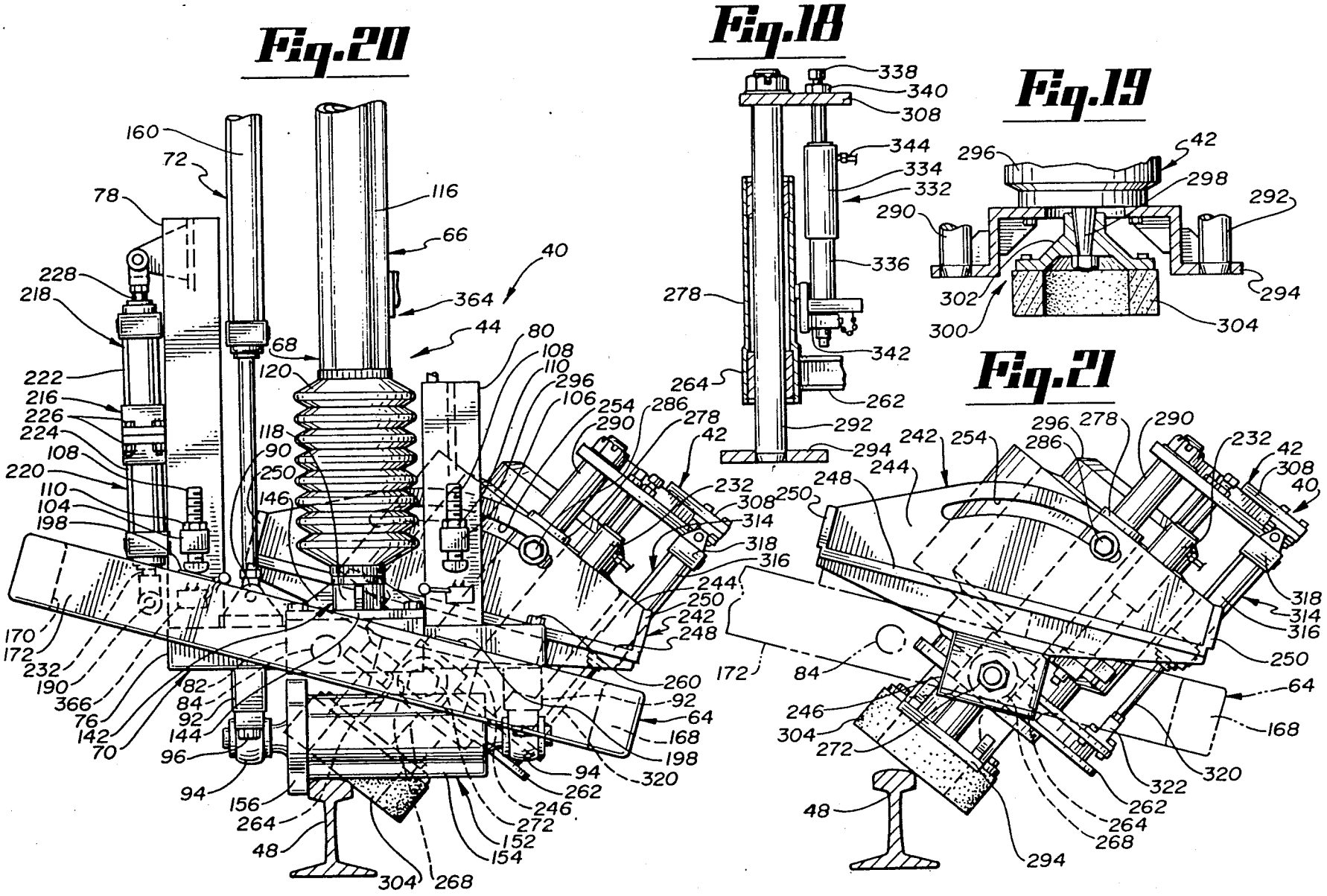
FIG. 18 is a section taken along line 18—18 of FIG. 6.
FIG. 19 is a section taken along line 19—19 of FIG. 17.
FIG. 20 is a front elevational view similar to that of FIG. 5, but showing the carriage tilt frame rotated (tilted) to the outside, the grinding assembly shifted laterally to the outside, and the grinding assembly rotated (tilted) to the outside.
FIG. 21 is a front elevational view similar to that of FIG. 20, but with parts removed for clarity.
Figure 23:
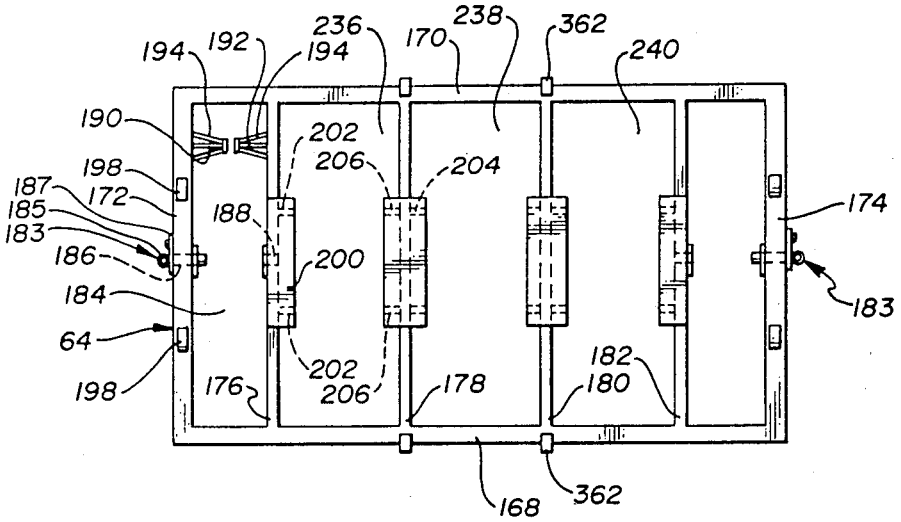
FIG. 23 is a plan view of the carriage tilt frame.

Tilt carriage frame support beams 176, 178, 180, 182 define grinding module receiving spaces 236, 238, 240. Individual grinding modules 42 are shiftably and tiltably supported on the support beams within spaces 236, 238, 240 by grinding module attachment plates 242. The attachment plates 242 each include upper, bell-shaped panel 244, and, as best seen in FIG. 21, lower, Y-shaped panels 246. The panels 244, 246 are integrally formed, but separated by support beam engaging shoulder 248. Shoulder 248 is fixedly supported between the panels 244, 246 by braces 250. Pivot channel 252 (FIG. 6) is received through the stem of the Y-shaped panel 246.

Arcuate slot 254 is defined by the upper portion of bell-shaped panel 244. Pivot channel 252 is positioned at the focal point of the arc defined by slot 254.

As seen in FIG. 7, attachment plate shoulders 248 include elongated slots 256. Bolts 260 are received through the slots 256 coupling the attachment plates 242 to respective carriage tilt frame support plates 200, 204.

Grinding module floor/tie plate 262 includes upward standing sleeves 264, 266. The sleeves 264, 266 each include outwardly extending lower pivot ears 268, 270 with integral threaded rods. The pivot ears 268, 270 are received within respective pivot channels 252 of the grinding module attachment plates 242, and are retained therein by nuts 272, 274. Referring to FIG. 6 and FIG. 7, rear support plate 276 extends between support tubes 278, 280. Support tubes 278, 280 extend upwardly from sleeves 264, 266 respectively. The support tubes 278, 280 include outwardly directed ears 282, 284 that are oriented with arcuate slots 254 in the bell-shaped panels 244 of grinding module attachment plates 242. Bolts 286 are received through each arcuate slot 254, selectively, fixedly coupling the support tube ears 282, 284 to respective attachment plates 242.

Grinding motor support cylinders 290, 292 are shiftably received within support tubes 278, 280, and are fixedly connected to grinding motor base plate 294. Grinding motor 296 is supported by the grinding motor support plate 294. As best seen in FIG. 19, the grinding shaft 298 extends through the base plate 294. Grinding head 300, comprised of backing 302 and grinding stone 304, are fixedly attached to the grinding motor shaft 298 for rotation therewith. Electrical junction box 306 is carried on the external sidewall of the grinding motor 296.

Grinding module top plate 308 extends between and is supported by the support cylinders 290, 292. Referring to FIG. 7, top plate 308 includes strength ribs 310 and grinding motor lift cylinder attachment panel 312.

Hydraulic piston and cylinder grinding motor lift assembly 314 extends between the floor plate 262 and top plate attachment panel 312. The cylinder 316 of the piston and cylinder lift assembly 314 is pivotally coupled to bracket 318 of top plate 308. The piston 320 of the lift assembly 314 is pivotally coupled to bracket 322 of floor plate 262. Lock up clevis 324 (see FIG. 6), with retaining pin 326, depends downwardly from top plate 308. Lock up arm 328 is pivotally coupled to bracket 330 on support tubes 280.

Referring to FIGS. 6 and 18, shock absorbing assembly 332 is positioned between grinding module top plate 308 and support tube 278. Assembly 332 includes first and second shiftable members 334, 336. Shiftable member 334 is restricted in upward travel by stop bolt 338 having lock nut 340. Shiftable member 336 is supported by bracket 342 to the support tube 278. Flexible air hose 344 extends between the first shiftable member 334 and the air hose receptacle 102 in support brace 70.

Carriage transport hooks 346 depend downwardly from grinding machine main frame 32. Transport hook attachment brackets 348 are carried by each carriage tilt frame support beam; for example, bracket 348 is fixedly coupled to support plate 204 by bolts 350 in FIGS. 6 and 7.

Figures 8, 9, 10, 22:
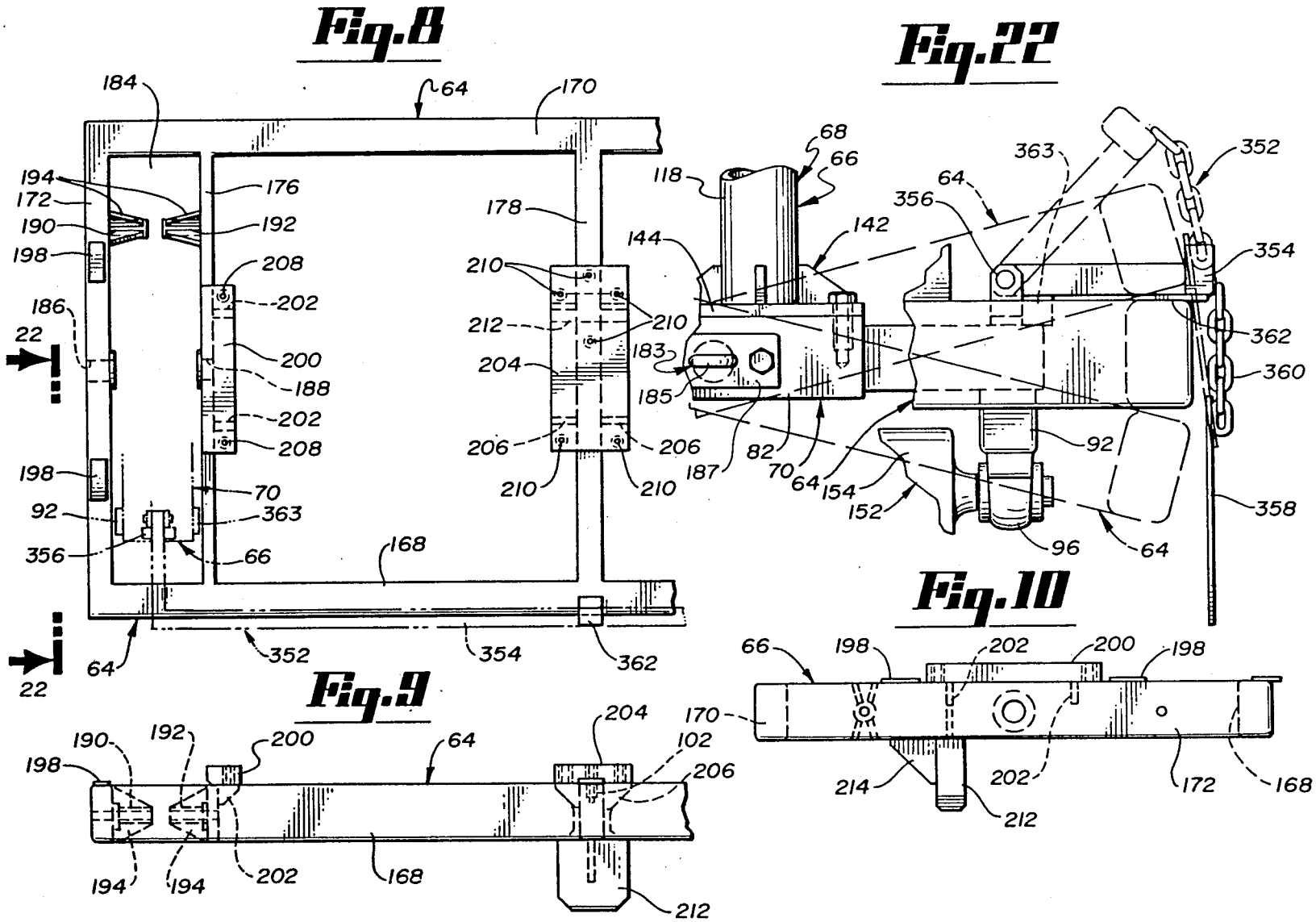
FIG. 8 is a fragmentary, plan view of the carriage tilt frame, taken from the same perspective as FIG. 7.
FIG. 9 is a fragmentary, left side elevational view of the carriage tilt frame, taken from the same perspective as FIG. 6.
FIG. 10 is a front elevational view of the carriage tilt frame, taken from the same perspective as FIG. 5.
FIG. 22 is a fragmentary, enlarged view of the carriage taken from the perspective of line 22—22 of FIG. 8, and with spark shield assembly added, phantom lines depicting the tilt frame in the two extreme positions of rotation (tilt), and the shield depicted in a secondary position.

Spark guard 352 is depicted in FIGS. 8 and 22. Spark guard 352 includes support arm 354 pivotally coupled to carriage support structure base beam 76 by bracket 356, a plurality of shield plates 358, and link chain 360 connecting individual shield plates 358 to the support arms 354. Referring to FIG. 8, spark guard arm supporting tabs 362 are carried by the tilt carriage side beams 168, 170. Arm support block 363 is carried on the outer edge of the base beam 76.

Figures 14, 15, 16, 17:
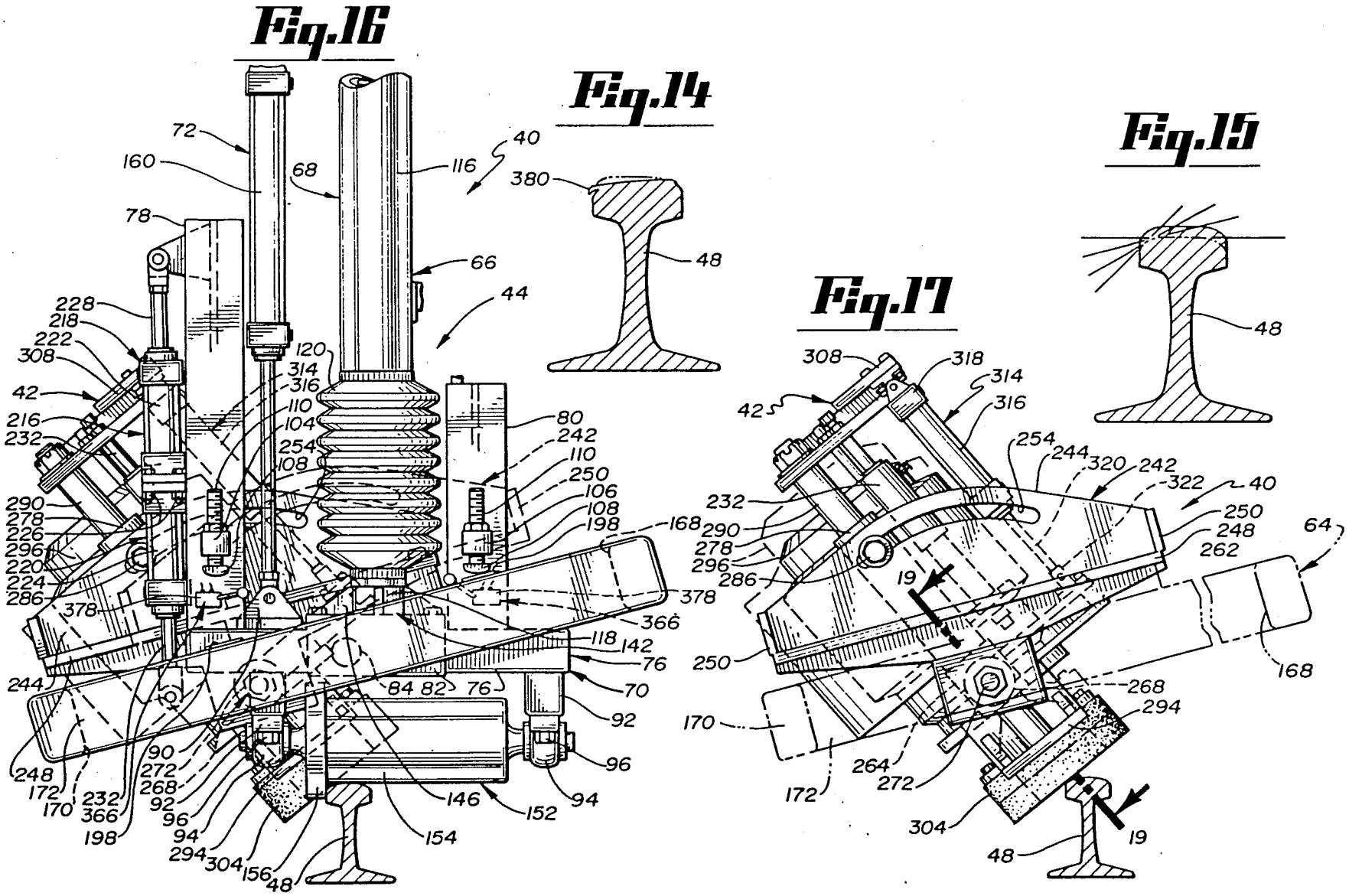
FIG. 14 is a vertical cross section of a railroad track rail depicting a typical burr and flowing wear pattern.
FIG. 15 is a vertical cross section of a railroad track rail with the maximum acceptable wear shown in phantom line, and also showing several lines representing grinding head angles required to achieve the necessary contour.
FIG. 16 is a front elevational view similar to that of FIG. 5, but showing the carriage tilt frame rotated (tilted) to the inside, the grinding assembly shifted laterally to the inside, and the grinding assembly rotated (tilted) to the inside.
FIG. 17 is a front elevational view similar to that of FIG. 16, but with parts removed for clarity.

Grinder carriage 44 includes carriage support structure extension sensing mechanism 364 and tilt angle sensing mechanisms 366. Extension sensing mechanism 364 includes switch 368 fixedly carried by outer slide tube 116, and adjustable actuating arm 370. Actuating arm 370 comprises upright rod 372 fixedly carried by carriage support structure base beam 76. Contact sleeve 374 is shiftably connected to rod 372 by set screws 376. Referring to FIG. 16, tilt sensing mechanisms 366 comprise sensing switches 378 mounted on the inboard and outboard upstanding I beams 78, 80.

In operation, the grinding assembly 40 of grinding machine 30, when not in use, is transported in uncontacting relationship with rail 48 in the configuration depicted in FIG. 3. In particular, brackets 348 of carriage tilt frame 64 are received by main frame hooks 346. The slide tube assembly 68 is fully retracted, the hydraulic spread piston and cylinder assembly 74 is extended, the hydraulic lift piston and cylinder assemblies 72 are partially extended, and the carriage tilt actuator assembly 216 is in the neutral, nontilting position. Lock arm 328 is received by bracket 324, locking the grinding module 42 in the raised position, with hydraulic grinding motor lift piston cylinders assembly 314 in their retracted position.

To commence grinding operations, rail grinding machine 30 is brought to a halt, and each grinding assembly 40 is lowered into position on to track rails 48. In particular, the lift piston and cylinder assemblies 72 are fully retracted, and spread piston and cylinder assemblies 74 are partially retracted, lifting the brackets 348 up and away from transport hooks 346. Lock up arm 328 is released from bracket 324, enabling the grinding motor 296 and grinding stone 304 to be lowered into position over rail 48. Once the brackets 348 are clear of the hooks 346, grinding assembly carriages 44 are lowered by extending respective lift assemblies 72.

Sleeve 374 of carriage extension sensing mechanism 364 is adjusted to contact switch 368 just prior to the contacting of carriage wheel 152 with rail 48. Actuation of switch 368 provides a signal to spread assembly actuation switch 167, causing the hydraulic spread piston and cylinder assembly 74 to fully retract. Wheel guide flange 156 of carriage wheel 152 is thereby brought flush with the inner sidewall of rail 48, properly positioning the grinding stone 304 in grinding relationship with the surface of rail 48. Rail engaging plate 212 will contact the rail 48, in the event that carriage wheel flange 156 fails to engage the rail 48, thereby limiting the outward swing of the carriage 44.

Corrugations in the surface of rail 48 are removed by rotating the grinding stone 304 in contacting, grinding relationship with the top surface of rail 48 as the rail grinding machine 30 proceeds along the track 46. When operated to remove corrugations, the grinding stone 304 is maintained in the nontilted, level position depicted in FIGS. 5 and 6. Upward pressure is continually exerted by the grinding motor hydraulic lift assembly piston and cylinder assembly 314, during operation of the grinding module, such that the entire weight of the grinding motor 296 is not carried on the rail 48.

As depicted in FIG. 14, rail 48 may develop burrs 380, or otherwise lose its symmetrical in cross section profile. Removal of burrs, or restoration of a symmetrical profile, can be accomplished by tilting the grinding stone 304 in relationship to the upright axis of the rail 48. As depicted in FIG. 15, various angles of tilt are required to accomplish the desired restoration.

The grinding modules 42 of the present invention can be adjusted to any angle between plus or minus 30° relative to the grinding module attachment plates 242 that couple the modules 42 to the carriage tilt frame 64, and the carriage tilt frame 64 can be adjusted to any angle between plus or minus 15° relative to the carriage frame suport structures 66. The present invention, therefore, allows for a total angle of tilt of the grinding stone 304 relative to upright axis of the rail 48 of between plus or minus 45°.

Tilting of the grinding module 42 relative to the carriage tilt frame 64 is accomplished by loosening bolts 286 received through the slots 254 of attachment brackets 242, and manually pivoting the grinding module 42 about the pivot axis defined by pivot channels 252. Bolts 286 are tightened to lock each grinding module 42 into the desired angle of tilt, after the grinding module 42 has been manually positioned. The manual tilting of the grinding module 42 relative to the carriage tilt fame 64 is preferably accomplished prior to lowering the grinding stone 304 into contact with rail 48.

The grinding module 42 is depicted in FIG. 7 as being centered over rail 48. That is to say, the shaft 298 of grinding motor 296 is aligned directly over rail 48. It is desirable to shift the grinding module 42 inboard or outboard relative to rail 48, when the module is to be operated in a tilted configuration, such that the grinding stone 304 is centered relative to the line of contact that it makes with rail 48. The grinding module 42 is shifted inboard or outboard by loosening the bolts 260 received through shoulders 248 of attachment plates 242, and manually shifting the attachment plates 242 relative to the carriage tilt frame 64.

Referring to FIGS. 16, 17, 20 and 21, carriage tilt frame 64 is tilted relative to the tilt frame support structure 66, and in particular base beam 76, by operation of the hydraulic tilt actuating assembly 216. Referring to FIG. 16, carriage tilt frame 64 is tilted to the inboard tilt configuration by extending center rod 232 of hydraulic piston and cylinder assembly 220 of tilt actuator 216. Piston rod 228 of upper piston and cylinder assembly 218 is maintained in the normally extended position. The carriage tilt frame 64 is thereby tilted about the pivot axis defined by pivot pins 183 received through pivot channels 84.

The angle of tilt of the tilt carriage 64 is controlled by stop bolts 108. Stop bolts 108 can be adjusted within sleeves 106, thereby adjusting the maximum angle to which the tilt frame 64 can be tilted before the pads 198 of the tilt frame 64 come into contact with the stop bolts 108.

Referring to FIG. 20, tilt frame 64 is tilted to the outboard tilt configuration by retracting piston rod 228 of upper piston and cyinder assembly 218 of the tilt actuator 216. Piston rod 332 of lower piston and cylinder assembly 220 is maintained in its normally retracted position. The carriage tilt frame 64 is thereby rotated about pivot pins 183. The maximum angle of tilt of tilt frame 64 is again controlled by the position of stop bolts 108.

Tilt sensing switch 366 located on the outboard I beam 80 is actuated when tilt frame 64 is fully tilted to its inboard tilt position (FIG. 16). Likewise, tilt sensing switch 366 located on the outboard I beam 78 is actuated when the tilt frame 64 is fully tilted to its outboard tilt position (FIG. 20). When it is predetermined that a carriage is to be tilted, the tilt sensing switches 366 are electrically coupled to the grinding module hydraulic lift piston and cylinder assembly 314 such that the piston rod 320 of the hydraulic lift assembly 314 is extended only when one of the sensing switches 366 are actuated. The grinding stone 304, therefore, is lowered into the grinding position over rail 48 only after it has been previously tilted to its predetermined angle of tilt. Likewise, the grinding stone 304 is lifted each time the carriage is shifted out of its tilted configuration.

Shock absorber 332 dampens up and down vibrations of the grinding module 42 as the rail grinding machine proceeds along track 46 during grinding operations. The shock absorber 232 is a self-contained unit having an internal viscous fluid and orifice plates that prevent, but do not inhibit, shifting of the first shiftable member 334 relative to the second shiftable member 336. Air is vented from the shock absorber 332, as the shiftable members move relative to each other, through air hose 344. The hose 344 is connected to air hose receptacle 102, which in turn leads to air filters for filtering the air that is vented to and from the shock absorber 332.

Referring to FIG. 22, spark shields 358 are connected to pivotal spark guard support arms 354 by link chains 360. The support arm 354 rests on pads 362 of carriage side beam 168 when the carriage 64 is in the level position. Likewise, the support arm 354 is carried by the tilt carriage side beam 168 when it is tilted upwardly, as depicted in FIG. 22, to the inboard tilted position. Spark shields 358 are thereby lifted upwardly so as to present a barrier to sparks flying upwardly from the rail 48 when the grinding stone 340 is operated in the inboard tilted position. Support arm 354 is pivotally coupled to the base beam 76 of the support brace 70 via bracket 356. The spark guard support arm 354 is inhibited from pivoting downwardly, when the tiltable carriage 64 is pivoted downwardly to the outboard tilt position, by the outer edge of the base beam 76, and support block 363 located thereon. The spark shields 358 are thereby prevented from dragging along the railroad track bed 52 when the carriage tilt frame 64 is tilted to the outboard grinding position.

We claim:

1. A rail grinding machine for restoring the surface of railroad track rails, said grinding machine including a main frame supported on said track by rail engaging wheels and adapted for travel along said rails comprising:

a grinding module including a grinding head adapted for contacting one of said rails in grinding relationship; and a carriage assembly operably coupling said grinding module to said main frame, said carriage assembly including:

carriage support structure depending from said main frame and positionable in fixed relationship with said rail surface;

a carriage tilt frame pivotally coupled to said carriage support structure at a tilt frame pivot axis oriented directly above said rail surface when said carriage support structure is in said fixed relationship with said rail surface; and grinding module attachment means for operably, pivotally coupling said module to said tilt frame at a grinding module attachment means pivot axis, whereby said grinding module can be tilted through a first angle relative to said tilt frame, and said tilt frame can be tilted through a second angle relative to said carriage support structure, such that said grinding head is shiftable about said rail surface through a third angle equaling the sum of said first and second angles.

2. A rail grinding machine as claimed in claim 1, said grinding module attachment means including means for laterally shifting said grinding module relative to said tilt frame such that said grinding module pivot axis can be shifted transversely of said rail surface when said carriage support structure is in said fixed relationship with said rail surface.

3. A rail grinding machine as claimed in claim 2, said tilt frame including first and second support beams oriented transversely to said one track rail, said means for laterally shifting said grinding module including first and second, opposed shiftable members shiftably supported by said first and second support beams, respectively, and a grinding module support member extending between and pivotally coupled to said shiftable members.

4. A rail grinding machine as claimed in claim 3, said grinding module support member comprising a floor plate extending between and pivotally coupled to said shiftable members, and means slidably coupling said grinding module to said floor plate for up and down shifting of said grinding module relative to said floor plate.

5. A rail grinding machine as claimed in claim 1, said carriage support structure including a carriage support member for tiltably carrying said tilt frame, means operably coupled to said support member and engageable with said one track rail for fixedly orienting said support member relative to said one track rail, and tilt actuating means extending between said support member and said tilt frame for selectively tilting said tilt frame to predetermined angles relative to said track rail.

6. A rail grinding machine as claimed in claim 5, said carriage assembly including means extending between said main frame and said support structure for shifting said support structure between an operating position wherein said support structure engages said one track rail for grinding operations, and a transport position wherein said support structure clears said one track rail.

7. A rail grinding machine as claimed in claim 4, said means slidably coupling said grinding module to said floor plate including opposed guide tubes carried by said floor plate, opposed module support cylinders coupled to said grinding module and slidably carried by said guide tubes, and actuating means extending between said floor plate and said grinding module for selectively shifting said grinding module relative to said floor plate.

8. The apparatus as claimed in claim 5, said means for fixedly orienting said support member comprising opposed, fore and aft, rail engaging rollers.

* * * * *